US006004717A

United States Patent [19]

Creatura et al.

[11] Patent Number: 6,004,717

[45] Date of Patent: Dec. 21, 1999

[54] CARRIER COATING PROCESSES

[75] Inventors: John A. Creatura, Ontario; K. Derek Henderson, Rochester; Bernard A. Kelly, Ontario, all of N.Y.

[73] Assignee: Xerox Corporation, Stamford, Conn.

[21] Appl. No.: 08/876,100

[22] Filed: Jun. 13, 1997

[51] Int. Cl.[6] ..... G03G 9/10

[52] U.S. Cl. ..... 430/137; 430/108

[58] Field of Search ..... 430/106.6, 108, 430/137; 427/216, 220, 221

[56] References Cited

U.S. PATENT DOCUMENTS 4,233,387 11/1980 Mammino ..... 430/137
4,810,611 3/1989 Ziolo et al. ..... 430/106.6
5,683,844 11/1997 Mammino ..... 430/108
5,700,615 12/1997 Silence et al. ..... 430/108

*Primary Examiner*—John Goodrow
*Attorney, Agent, or Firm*—John L. Haack

[57] ABSTRACT

A process comprising:

blending core particles with a first coating resin or resin mixture to produce a first blend;

heating the resulting first blend to produce first coated particles;

blending the resulting first coated particles with a second coating resin or resin mixture to form a second blend; and heating the second blend to afford second or twice coated particles.

21 Claims, 2 Drawing Sheets

CARRIER COATING PROCESSES

REFERENCE TO COPENDING AND ISSUED PATENTS

Attention is directed to commonly owned and assigned copending application U.S. Ser. No. 08 785,675 (D/96536) filed Jan. 27, 1997, entitled "Coated Carrier Particles", there is illustrated carrier particles with coatings containing copper iodide; and U.S. Ser. No. 08/ not yet assigned (D/96700) filed concurrently herewith, entitled "Coated Carriers", there is illustrated a composition comprised of a strontium ferrite core and thereover a mixture of a first and second polymer, and wherein the first polymer contains a conductive component, and the second polymer contains copper iodide, and wherein the first and second polymer coating weight is from about 5 to about 25 weight percent.

The disclosure of the above mentioned copending applications are incorporated herein by reference in their entirety.

BACKGROUND OF THE INVENTION

The present invention is generally directed to processes for the preparation of resin coated particulate materials, for example, carrier particles especially for use in two component xerographic developers. More specifically, the present invention relates to improved dry powder coating processes for the preparation of polymer coated porous metal oxide core particles.

The present invention relates to processes for the preparation of polymer coated carrier particles, and more specifically dry powder coating processes for the preparation of polymer coated porous particles comprising relatively small sized metallic sponge carrier particles, with a first coating thereover comprised of a first polymer material of relatively low cost, for example, less than about 1 to about 3 dollars (U.S.) per pound which functions primarily as a filler, a mechanical stability enhancer, or as a sacrificial material, and a second coating thereover comprised of a second polymer or mixture of polymers with a relatively higher cost, for example, for about 3 to about 20 or more dollars (U.S.) per pound and having superior triboelectric charging and/or conductive properties compared to the first polymer coating material.

Dry polymer coating processes for carrier particles are known in the art, such as U.S. Pat. No. 3,590,000 (Mammino, et al.), U.S. Pat. No. 4,233,387 (Mammino, et al.), U.S. Pat. No. 4,935,326 (Creatura, et al.), U.S. Pat. No. 4,937,166 (Creatura, et al.), and U.S. Pat. No. 5,002,846 (Creatura, et al.).

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith as it is these values that enable continued constant developed images of high quality and excellent resolution.

Additionally, carrier particles for use in the development of electrostatic latent images are described in many patents including, for example, U.S. Pat. No. 3,590,000. These carrier particles can be comprised of various cores, including steel, with a coating thereover of fluoropolymers, and terpolymers of styrene, methacrylate, and silane compounds. Past efforts have focused on the attainment of coatings for carrier particles for the purpose of improving development quality, and also to permit particles that can be recycled, and that do not adversely effect the imaging member in any substantial manner. A number of these coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coating resides in fluctuating triboelectric charging characteristics, particularly with changes in relative humidity. The aforementioned modification in triboelectric charging characteristics provides developed images of lower quality, and with background deposits.

There is illustrated in U.S. Pat. No. 4,233,387, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles can be substantially constant, and moreover, the triboelectric values can be selected to vary significantly, for example, from less than −30 microcoulombs per gram to +40 microcoulombs per gram.

There is illustrated in U.S. Pat. Nos. 4,937,166 and 4,935,326, carrier containing a mixture of polymers, such as two polymers, not in close proximity in the triboelectric series. Moreover, U.S. Pat. No. 4,810,611, discloses that there can be added to carrier coatings colorless conductive metal halides in an amount of from about 25 to about 75 weight percent, such halides including copper iodide, copper fluoride, and mixtures thereof. In the '611 patent, the conductivity ranges are considered relatively narrow, and the carrier tribo charge is not believed to be of a wide range, disadvantages overcome, or minimized with the present invention.

Carriers obtained by applying insulating resinous coatings to porous metallic carrier cores using solution coating techniques are undesirable from many viewpoints. For example, the coating material will usually reside in the pores of the carrier cores, rather than at the surfaces thereof; and, therefore, is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome these disadvantages, and further enable developers that are capable of generating high and useful triboelectric charging values with finely divided toner particles; and also wherein the carrier particles are of substantially constant conductivity. Further, when resin coated carrier particles are prepared by the powder coating process of the present invention, the majority of the coating materials are fused to the carrier surface thereby reducing the number of toner impaction sites on the carrier material. Additionally, there can be achieved with the process of the present invention and the carriers thereof, independent of one another, desirable triboelectric charging characteristics and conductivity values; that is, for example the triboelectric charging parameter is not dependent on the carrier coating weight as is believed to be the situation with the process of U.S. Pat. No. 4,233,387, wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations. Thus, for example, there can be formulated in accordance with the invention of the present application developers with conductivities of from about $10^{-6}$ ohm-cm to about $10^{-17}$ ohm-cm, about $10^{-10}$ ohm-cm to about $10^{-6,}$ and preferably from about $10^{-8}$ ohm-cm to about $10^{-6}$ ohm-cm, determined in a magnetic brush conducting cell, and a wide carrier triboelectric charging value of from about −30 to about +40, and in embodiments, of from about −25 to about +25 microcoulombs per gram on the carrier particles as determined by the known Faraday Cage technique.

Other U.S. Patents that may be of interest include U.S. Pat. No. 3,939,086, which illustrates steel carrier beads with polyethylene coatings (see column 6); U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220.

The aforementioned references are incorporated in their entirety by reference herein.

In polymer particle coating processes of the prior art, various significant problems exist. There is inherent difficulty present in small particle polymer coating processes that has long been recognized. Large amounts of polymer are required for complete coating as the particle size of the core is reduced and the relative surface to volume ratio increases. These large amounts of polymer, 10 to 20 percent by weight of the core/polymer composition, cause unusually high numbers of bead to bead contacts leading to processing failure. For certain ferrite cores, the problem can be severe. These cores are small, for example, less than about 50 microns, porous, and structurally very weak. Additionally the cores are often insulative and require application of considerable amounts of conductive polymer to render the carrier conductive. Cost is another important consideration. Coating polymers tend to be expensive and can add about $ 5 per pound to the carrier unit manufacturing costs. A design that enables a function and minimizes the amount of expensive polymer in the composition is therefore desirable. The present invention provides an economical and efficient method to provide the functionality of a carrier composed entirely of the expensive conductive carrier coating without using the conventional high coating weights necessary to achieve both full coverage and desired conductivity levels.

The aforementioned and other disadvantages are avoided, or minimized with the coating processes of the present invention.

Thus, there remains a need for simple and economical coating processes for the preparation of resin coated carrier core particles wherein the core particles are highly porous and friable, and wherein the resulting coated particles are of low porosity and mechanically robust.

The processes and products of the instant invention are useful in many applications, for example, as a variety of specialty applications including electrophotographic developers used for electrophotographic imaging processes, and for use, for example, in thermoplastic and thermoset films and coating technologies.

Practitioners in the art have long sought an inexpensive, efficient and environmentally efficacious method for producing resin coated carrier core particles wherein the core particles are highly porous and friable, and wherein the resulting coated particles are of low porosity and mechanically robust.

SUMMARY OF THE INVENTION

Embodiments of the present invention, include:

overcoming, or minimizing deficiencies of prior art processes, by providing carrier coating processes with improved efficiency, improved flexibility, and improved operational economies;

providing a process for the preparation of resin coated particles comprising:

blending core particles with a first coating resin or resin mixture to produce a first blend;

heating the resulting first blend to produce first coated particles;

blending the resulting first coated particles with a second coating resin or resin mixture to form a second blend; and heating the second blend to afford second or twice coated particles.

The aforementioned process can optionally include collecting, cooling, and sizing the resulting coated particles.

In another embodiment of the present invention is provided a process for the preparation of resin coated particles comprising:

a) dry blending core particles with a first coating resin or resin mixture to produce a first blend;

b) heating the resulting blend to produce first coated particles;

c) repeating steps a) and b) with the first coating resin or resin mixture and the intermediate resulting coated particles from 1 to about 20 times;

d) blending the coated particles of step c) with a second coating resin or resin mixture to form a second blend;

e) heating the second blend to form to produce second resin coated particles; and f repeating steps d) and e) with the second coating resin or resin mixture and the intermediate resulting coated particles from 1 to about 20 times; wherein there results multiple resin coated core particles wherein desired coating weight, structural integrity, triboelectric charging, conductivity and/or resin surface coverage is achieved.

Still in other embodiments of the present invention there are provided coating processes wherein the aforementioned coated carrier particles from single or multiple passes can be subsequently coated with the first coating resin or resin mixture.

The developers of the present invention can be formulated with constant conductivity values with different triboelectric charging characteristics by, for example, maintaining the same total coating weight on the carrier particles and changing the relative amounts or the ratio of the dissimilar first and second polymer coating resins. Similarly, there can be formulated developer compositions wherein constant triboelectric charging values are achieved and the conductivities are altered by retaining the same total coating weight on the carrier particles.

DETAILED DESCRIPTION OF THE INVENTION

Figure 1:
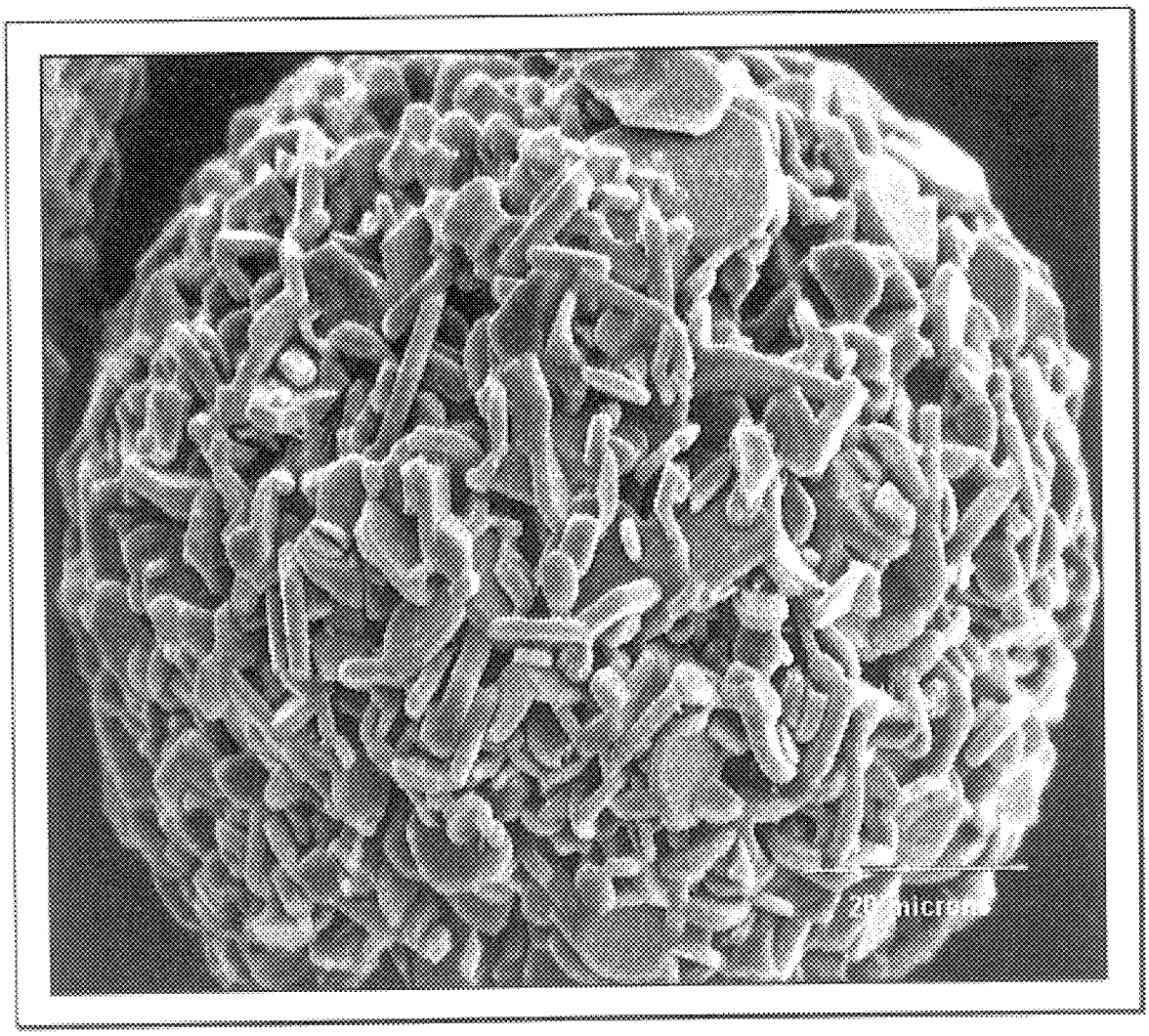
FIG. 1 is a photograph of an exemplary uncoated core particle prior to coating in accordance with processes of the present invention.

The particle coating processes of the present invention may be used to process and prepare a variety of particulate and polymeric materials, including carrier core particles for used in dry developer marking applications in a cost efficient manner. An advantage of the present invention is that the processes thereof affords control over the coating and surface properties of the resulting coated particulate products, and control over the porosity and triboelectric charging properties of the resulting coated core particles.

In embodiments, the present invention provides processes for the preparation of resin coated particles, and more specifically, a process for the preparation of resin coated particles comprising:

blending core particles with a first coating resin or resin mixture to produce a first blend;

heating the resulting first blend to produce first coated particles;

blending the resulting first coated particles with a second coating resin or resin mixture to form a second blend; and heating the second blend to afford second or twice coated particles, and optionally collecting, cooling, and sizing the resulting coated particles.

The uncoated core particles are highly porous, for example, with a BET surface area (nitrogen absorption) of from about 0.01 to about 1.0 square meters per gram, which surface area is about three times the theoretical surface area of a solid spherical particle with the same diameter and material density. The core particles, in embodiments, can be selected, for example, from known ferrites, magnetites, porous or sponge metallic cores, and the like, and mixtures thereof. The core particles, in embodiments, have a volume average diameter of from about 10 to about 150 microns, and preferably the core particles, in embodiments, can have, for example, a volume average diameter of from about 10 to about 60 microns.

The first coating resin is, for example, a cross-linkable thermoset resin, and in embodiments, can be polymers such as polyurethanes, polyesters, polyacrylics, phenolic resins, amino resins, epoxy resins, and the like polymers, and mixtures thereof. The first coating resin can function primarily as a sacrificial filler for the purpose of filling in substantially all the pores on or in the surface of the core particles. The first coating resin may be used at relatively low loading weights, for example, of from about 0.5 to about 15 weight percent, and preferably from about 1.0 to about 10 weight percent, and more preferably from about 1.0 to about 5.0 weight percent, depending on core particle size and core particle porosity. The first coating resin can any suitable resin material, such as, non-crosslinked thermoplastic polymers and copolymers, crosslinked thermoplastics, thermoset plastics, and the like, and mixtures thereof.

The second coating resin can be, for example, polymers and mixtures thereof which impart triboelectric values between about −60 $\mu$C/gram to about +60 $\mu$C/gram, or more specifically from about −30 to about +40 $\mu$C/gram, electrical conductivity values between about $10^{-6}$ to about $10^{-15}$ mho/cm at 50 volts, and mechanical stability to the resulting coated particles, that is, the coated particle is mechanically more robust.

In accomplishing the coating of the core particles, heating of the first resin or resin polymer blend coating, in embodiments, is accomplished at or above the crosslinking temperature of the first coating resin, and thereby the process provides a relatively completely coated core particle surface. The heating can be accomplished in a variety of apparatus, and preferably in, for example, a rotatory kiln. The total weight of the first and second coating polymers can be applied in amounts of from about 1 to about 20 weight percent of the total weight of the uncoated core particles. The first resin or resin mixture and the second resin or resin mixture, in embodiments, can be sequentially and separately applied to the core particles in of from about 2 to about 10 times. In embodiments, the first and or the second coating resin can contain a conductive compound or compounds selected from the group consisting of a pigment, such as carbon black or other colored or colorless pigments, a metal halide, metals, metal oxides, and the like, and mixtures thereof.

The first and second coating resin or resin mixtures selected can be the same, that is identical, or dissimilar, depending for example, on the presence of additives, molecular weight, ratio of individual polymer resins in a mixture of resins, and the like variations, of each resin coating composition selected for each coating operation.

In still other embodiments, the present invention provides multiple step or stage coating processes for the preparation of resin coated carrier particles comprising:

a) dry blending core particles with a first coating resin or resin mixture to produce a first blend;

b) heating the resulting blend to produce first coated particles;

c) repeating steps a) and b) with the first coating resin or resin mixture and the intermediate resulting coated particles from 1 to about 20 times;

d) blending the coated particles of step c) with a second coating resin or resin mixture to form a second blend;

e) heating the second blend to form to produce second resin coated particles; and f repeating steps d) and e) with the second coating resin or resin mixture and the intermediate resulting coated particles from 1 to about 20 times; for example, until the desired coating weight, structural integrity and/or surface coverage is achieved.

As mentioned above, the first and second coating resin can be same or preferably triboelectically dissimilar. The total coating weight of the resins selected is of from about 1 to about 30 weight percent based on the weight of the uncoated carrier particles. The resulting multiple pass coated carrier particles have a triboelectric charge of from about −60 $\mu$C/gram to about +60 $\mu$C/gram, and a conductivity of from about $10^{-6}$ mho/cm at 10 volts to about $10^{-15}$ mho/cm at 50 volts.

Figure 2:
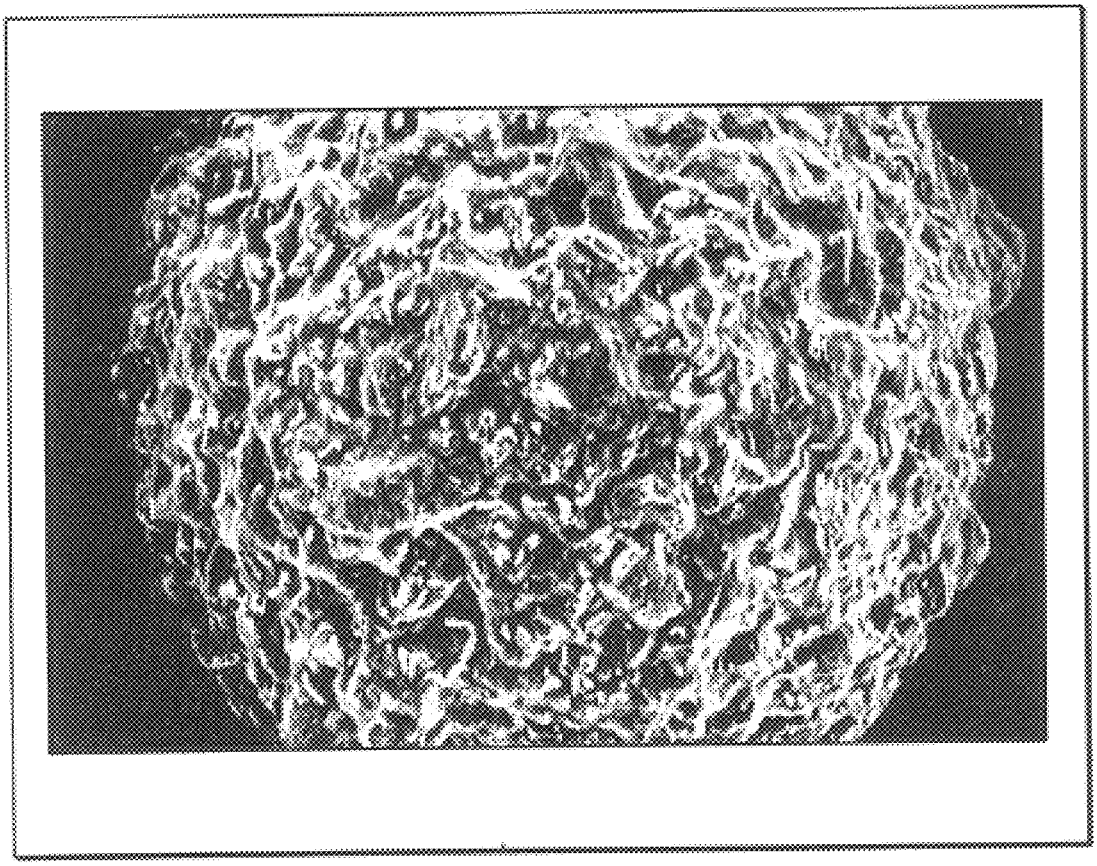
FIG. 2 is a photograph, in embodiments, of an exemplary resin coated core particle prepared by coating a bare or uncoated core particle with one or more resins in accordance with processes of the present invention.

Referring to the Figures, there is illustrated in FIG. 1, a photograph of a highly porous strontium ferrite core particle prior to coating, and in FIG. 2, a photograph of an example of the strontium ferrite core particle after a multiple resin coating process of the present invention. Photographic images were obtained from microscopic examination of the respective samples at the indicated magnifications. It is evident to one of ordinary skill in the art that the multiple coated carrier core particle shown in FIG. 2 has considerably less surface area than is present in the precursor uncoated core particle shown in FIG. 1. Is also evident that the multiple coated core particles obtained, in embodiments of the present invention, possess improved mechanical robustness, for example, the core surfaces are reinforced by the polymeric coatings residing therein or thereon, in that the coated particles are less prone to breakdown under the influence of shear forces of the type experienced in typical xerographic developer housings. The triboelectric charge and conductivity also change as a function of the number of passes because the coating weight increases and the surface coating composition may change, as illustrated herein.

In embodiments, a mechanically durable polymer is selected as the first coating resin or in a resin admixture, such as cross linked or cross linkable polymer, to improve the mechanical stability of the core particle. Once the pores and the surface of the core particle is saturated, that is, the porous voids of the core particle are filled with the durable polymer, then a functional resin or resin mixture can coated onto the precoated polymer surface of the core particle in a single or in multiple passes to attain the desired functional properties, for example, triboelectric charging and conductivity. In other embodiments, by judicious selection of the coating resins or mixture of resins, and the core particles, either a positively or a negatively charging coated carrier composition can be obtained. For example, when a negatively charging core particle has a positively charging ultimate and or penultimate resin surface coating, the coated particle with will charge positively. Similarly, when a positively charging core particle has a negatively charging ultimate and or penultimate resin surface coating, the coated particle with will charge negatively. Also, in embodiments, substantially electrically insulating core particles, such as insulative strontium ferrite cores, can be rendered moderately to highly conductive by the application of conductive coating resins as illustrated herein.

Toner compositions can be prepared by a number of known methods, such as admixing and heating resin particles such as styrene butadiene copolymers, colorant particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder equipped with a classifier wheel and then classified.

Illustrative examples of resins suitable for toner and developer compositions of the present invention include branched styrene acrylates, styrene methacrylates, styrene butadienes, vinyl resins, including branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference.

In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected.

When the pigment particles are comprised of magnetites, thereby enabling single component toners in some instances, which magnetites are a mixture of iron oxides (FeO—$Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight.

Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition used in conjunction with the coated carriers of the present invention can be prepared by a number of known methods as indicated herein including extrusion melt blending the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, more preferably from about 8 to about 12 microns, and most preferably from about 5 to about 8 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions, in embodiments, of the present invention possess desirable narrow charge distributions, optimal charging triboelectric values, preferably of from 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of the Polymer Coating Composition 1,091 Grams of copper iodide (obtained from Shepard Chemicals) and 273 grams of polyurethane polymer (Envirocron obtained from PPG Industries, Inc.) were combined and processed in an extruder (APV) with the following process parameters: 260° F. barrel temperature, 255° F. die head temperature, 41 percent load, a feed rate of 7.9 grams per minute, and a tool speed of 150 rotations per minute. The resulting extrudate, comprised of 80 percent by weight copper iodide dispersed uniformly in the Envirocron resin, was size reduced by mechanical attrition in a 100 AFG fluid energy mill with the following process parameters: grinding pressure of 100 pounds per square inch at a feed rate of 200 grams per minute. The volume median particle size after mechanical attrition was 3.4 microns.

Polymer Coating of Carrier Particles

The carrier coating process comprised five separate coating process steps. In the first step of the five step carrier coating process, 32.66 grams of a 20 weight percent Conductex SC Ultra conductive carbon black-loaded poly (methylmethacrylate) with a volume median particle size of 2 microns produced in a chemical process prior to mixing and 8.16 grams of the above prepared copper iodide loaded Envirocron were mixed for two minutes by hand to produce the polymer powder coating mixture. Next 2,041 grams of 75 micron porous strontium ferrite (available from Powder Tech Corp.) with a magnetic moment of 49.9 EMU per gram, a retentivity of 27.9 EMU per gram, and a coercivity of 1,640 Oersted, was mixed with 40.82 grams of above prepared polymer powder coating mixture. The mixing was accomplished in a V-Cone blender with the following process conditions: blender speed of 23.5 rotations per minute, and a blend time of 45 minutes. There resulted uniformly distributed and electrostatically attached polymer on the core particles determined by visual inspection. Thereafter, the resulting carrier particles were inserted into a rotating tube furnace for a period of 30 minutes. This furnace was maintained at a temperature of 400° F. causing the polymers to melt and fuse to the core particles. The product from the first step was screened through an 84 TBC(tensile bolt cloth) mesh screen to remove any large agglomerates.

The second step of the five step carrier coating process comprised mixing 1,750 grams of the output of the above first step with 35 grams of polymer powder coating mixture that was prepared by hand mixing for about 2 minutes, 28 grams of the carbon black-loaded poly (methylmethacrylate), and 7 grams of the copper iodide loaded Envirocron mixture. This mixing was accomplished in a V-Cone blender with the following process conditions: blender speed of 23.5 rotations per minute, and a blend time of 45 minutes. There resulted uniformly distributed and electrostatically attached powder on the surface of the polymer surface coated particles obtained from the first coating step. The resulting mixture was then placed in a rotating kiln furnace for 30 minutes at a peak temperature of 400° F. causing the polymer powder to melt and fuse to the polymer surface coating. The product from the second step was then screened through a 84 TBC(tensile bolt cloth) mesh screen to remove any large agglomerates.

The third step of the five step carrier coating process comprised mixing 1,400 grams of the coated particles from the above second step with 7 grams polymer powder coating mixture consisting of 5.6 grams of the carbon black-loaded poly(methylmethacrylate) and 1.4 grams of the copper iodide loaded Envirocron. This mixing was accomplished in a V-Cone blender with the following process conditions: blender speed of 23.5 rotations per minute, and a blend time of 45 minutes. There resulted uniformly distributed and electrostatically attached polymer on the powder from the second step as determined by visual observation. The resulting mixture was then placed in a rotating kiln furnace for 30 minutes at a peak temperature of 400° F. causing the powder to melt and fuse to the polymer surface coating obtained from the second step. The product from the third step was then screened through a 84 TBC (tensile bolt cloth) mesh screen to remove any large agglomerates.

The fourth step of the five step carrier coating process comprised mixing 1,100 grams of the output of the above third step with 11 grams of polymer powder coating mixture that was prepared by hand mixing 8.8 grams of the carbon black-loaded poly(methylmethacrylate) and 2.2 grams of the copper iodide loaded Envirocron. This mixing was accomplished in a V-Cone blender with the following process conditions: blender speed of 23.5 rotations per minute and a blend time of 45 minutes. There resulted uniformly distributed and electrostatically attached powder on the polymer surface coat from the third step as determined by visual inspection. The resulting mixture was then placed in a rotating kiln furnace for 30 minutes at a peak temperature of 400° F. thereby causing the polymer powder to melt and fuse to the polymer surface coat obtained in the third step. The product from the fourth fusing was then screened through a 84 TBC(tensile bolt cloth) mesh screen to remove any large agglomerates.

The fifth step of the five step carrier coating process comprised mixing 1,000 grams of the output of the above fourth step with 10 grams of polymer powder coating mixture that was prepared by hand mixing 8 grams of the carbon black-loaded poly(methylmethacrylate) and 2 grams of the copper iodide loaded Envirocron mixture. This mixing was accomplished in a V-Cone blender with the following process conditions: blender speed of 23.5 rotations per minute, and a blend time of 45 minutes. There resulted uniformly distributed and electrostatically attached polymer powder on the polymer surface coated carrier particles obtained from the fourth step determined by visual inspection. The resulting mixture was then placed in a rotating kiln furnace for 30 minutes to reach a peak temperature of 400° F. causing the polymer powder on the surface of the polymer coated particles to melt and fuse to the polymer coated surface obtained from the fourth step. The product from the fifth step was then screened through a 84 TBC(tensile bolt cloth) mesh screen to remove any large agglomerates. The final product was comprised of a carrier core with a total of 6.5 percent polymer mixture by weight on the surface with the polymer coating consisting of 80 percent by weight of the carbon black loaded poly(methylmethacrylate) and 20 percent by weight of the copper iodide loaded Envirocron polyurethane mixture.

A developer composition was then prepared by mixing 200 grams of the above prepared carrier with 10 grams of a toner composition comprised of 75.73 percent by Resapol HT resin, an uncrosslinked bisphenol-A propylene oxide fumarate polymer, available from Resana, 17.67 percent by weight of a benzoyl peroxide crosslinked bisphenol-A propylene oxide fumarate polymer with 33–40 percent gel content, 6.6 percent by weight flushed (flushed with what? and how much ??) Sun Blue pigment, and 0.3 percent by weight of a surface-treated silica TS-530 (available from Cabosil Corp., 8 nanometer particle size with a surface treatment of hexamethyidisilazane) which treated silica was injected during grind.

Thereafter, the triboelectric charge on the carrier particles was determined by the following process. It consists of two plane parallel non-magnetic electrodes with a 1.0 cm separation. The bottom electrode is connected to an electrometer. In close proximity to the bottom electrode is a segmented magnetic doughnut. The magnet rotates in a plane parallel to the electrode. The developer will respond by allowing the carrier to flip and walk around the ring defined by the magnetic field. Applying a potential difference between the electrodes with the field in the proper direction will pull toner across the gap as it becomes free from the carrier. The integrated charge on the toner that is transported across the gap is measured by the electrometer. The mass of the toner is measured by weighing the upper plate and a charge to mass ratio is calculated. The measured on the carrier was +21.5 microcoulombs per gram. Further, the conductivity of the carrier, as determined by the known Balsbaugh cell process by imposing a 50 volt potential between the plates, was $2.47\times10^{-9}$ mho-cm$^{-1}$. Therefore, these carrier particles were conducting.

In all the Examples, the triboelectric charging values and the conductivity numbers were obtained in accordance with the aforementioned procedure.

EXAMPLES II–X

The multiple pass carrier process was repeated from Example I with different cores, carrier coatings, coating weights, and number of passes. The carriers were measured for conductivity by the method described in Example I. Developers were made according to the procedure described in Example I and their triboelectric charge was measured by the procedure described in Example I against the same toner. These examples are summarized in Table 1. Table 2 lists the core particle properties prior to coating.

TABLE 1

Coated Core Particle Properties and Characterization

| Example # | Pass # | Polymer #1 & Amount (g) | Polymer #2 & Amount (g) | Carrier & Amount (g) | Tribo-electric Charge (μC/g) | Conduc-tivity (mho/cm) @ 10 V |
|---|---|---|---|---|---|---|
| II | 1 | A 40.82 | n/a | 75 μm strontium ferrite[1] 2041 | | |
| | 2 | A 35 | n/a | Product fro Pass #1 1750 | | |
| | 3 | A 7 | n/a | Product from Pass #2 1400 | | |
| | 4 | A 6.5 | n/a | Product from Pass #3 1100 | | |
| | 5 | A | n/a 5 | Product from Pass #4 1000 | 25.4 | 2.63E-08 |
| III | 1 | C 360 | n/a | 75 μm strontium ferrite 9000 | | |
| | 2 | C 45 | n/a | Product from Pass #1 4500 | −20.5 | 2.83E-07 |
| IV[6] | 1 | A 96 | B 24 | 50 μm strontium ferrite 1500 | | |
| | 2 | A 48 | B 12 | Product from Pass #1 750 | 14.9 | 2.83E-07 |
| V[5,6] | 1 | B 800 | n/a | 50 μm strontium ferrite 10000 | | |
| | 2 | B 656 | n/a | Product from Pass #1 8200 | | |
| | 3 | B 400 | n/a | Product from Pass #2 5000 | −22.6 | 2.08E-08 |
| VI[5] | 1 | A 80 | B 20 | 30 μm strontium ferrite[2] 1000 | | |
| | 2 | A 68 | B 17 | Product from Pass #1 850 | | |
| | 3 | A 10.4 | B 2.6 | Product from Pass #2 650 | | |
| | 4 | A 8.8 | B 2.2 | Product from Pass #3 550 | | 1.04E-09 |
| VII | 1 | A 6 | B 24 | 100 μm strontium ferrite[2] 1000 | | |
| | 2 | A 19.2 | B 4.8 | Product from Pass #1 800 | | 7.66E-09 |
| VIII | 1 | D 50.8 | A 21.78 | 30 μm strontium ferrite[1] 3628 | | |
| | 2 | D 46.2 | A 19.8 | Product from Pass #1 3300 | | |
| | 3 | D 39.2 | A 16.8 | Product from Pass #2 2800 | | |

TABLE 1-continued

Coated Core Particle Properties and Characterization

| Example # Pass # | Polymer #1 & Amount (g) | Polymer #2 & Amount (g) | Carrier & Amount (g) | Tribo-electric Charge (μC/g) | Conduc-tivity (mho/cm) @ 10 V |
|---|---|---|---|---|---|
| 4 | D 28 | A 12 | Product from Pass #3 2000 | 7.7 | 2.30E-15 |
| IX 1 | D 36.28 | A 36.28 | 30 μm strontium ferrite[1] 3628 | | |
| 2 | D 33 | A 33 | Product from Pass #1 3300 | | |
| 3 | D 28 | A 28 | Product from Pass #2 2800 | | |
| 4 | D 20 | A 20 | Product from Pass #3 2000 | 17.2 | 1.11E-14 |
| X 1 | D 21.78 | A 50.8 | 30 μm strontium ferrite[1] 3628 | | |
| 2 | D 19.8 | A 46.2 | Product from Pass #1 3300 | | |
| 3 | D 16.8 | A 39.2 | Product from Pass #2 2800 | | |
| 4 | D 12 | A 28 | Product from Pass #3 2000 | 22.6 | 1.11E-14 |

Table 1 Notes:
A = carbon black doped polymethylacrylate
B = copper iodide doped Envirocron (from Example 1)
C = copper iodide doped Envirocron (described in Example III below)
D = polyvinylidine fluoride ° F.
[1]PowderTech Corporation
[2]FDK Corporation
[3]Blender Type = V-Cone, except Example V = Munson MSR
[4]Blender RPM 23.5 rpm, except Example V = 50 rpm
[5]Blend Time = 45 minutes, except Examples V and VI = 30 minutes
[6]Kiln Temperature = 400 ° F., except Examples IV and V = 450

TABLE 2

Core Particle Properties and Characterization

| Vendor/Source | Core Size | Magnetic Moment (EMU/g) | Retentivity (EMU/g) | Coercivity (Oe) |
|---|---|---|---|---|
| PowderTech | 75 | 49.9 | 27.9 | 1640 |
| | 50 | 49.9 | 28.3 | 1640 |
| | 30 | 50.8 | 29.4 | 1641 |
| FDK | 30 | 49.7 | 31.8 | 2920 |
| | 100 | 49.4 | 29.9 | 1820 |

*All under 6,000 Oe Field

EXAMPLE III

Material Preparation 40 pounds of copper iodide (obtained from Shepard Chemicals) and 10 pounds of polyurethane polymer (Envirocron by PPG Industries, Inc.) were combined and processed in an extruder (ZDSK-28) with the following process parameters: 257–284° F. barrel temperatures, 275° F. die head temperature, 281° F. melt temperature, a feed rate of 34.0 grams per minute, and a screw speed of 356 rotations per minute. The resulting extrudate comprised of 80 percent copper iodide by weight dispersed uniformly in the Envirocron resin was size reduced by mechanical attrition in a 15" Sturtevant fluid energy mill with the following process parameters: feed pressure of 120 pounds per square inch, grinding pressure of 120 pounds per square inch, and flood feeding. The volume median particle size after mechanical attrition was 4.8 microns.

High Coating Weight Carriers

Coating weights of polymer or polymers on the carrier core in excess of about 5 percent by weight enable, for example, conductive carrier properties with substantially insulative strontium ferrite cores. For example, using a 75 micron porous strontium ferrite core, obtained from PowderTech Corporation, the conductivity of a carrier coated with various percentages of polymer comprised of a mixture of 20 percent by weight of a polyurethane/80% Cul composite and 80 precent by weight of a polymethylmethacrylate/19% carbon black composite, carriers 1 to 5 listed in the accompanying Table 3, as a function of the total polymer coating weight. At polymer coating weights below 4.5 percent by weight, the coating is substantially insulative. The carrier becomes semiconductive at 5.5 percent polymer coating on the carrier, with a measured conductivity of $4.9\times10^{-12}$ mho/cm, and fully conductive with a conductivity of $2.5\times10^{-9}$ mho/cm at a polymer coating weight of 6.5 weight precent. The triboelectric value, in the situation where the intrinsic triboelectric value of the polymer mixture is substantially different from the intrinsic triboelectric value of the carrier core, is expected to change substantially with increased polymer coating weight above about 5 weight percent from the undesirable value of the core to the desired value of the polymer coating.

TABLE 3

Conductivity of coated carrier core particles with varying coating weight.

| Carrier # | Total Coating Weight Percent[1] | Carrier Conductivity (mho/cm) |
|---|---|---|
| 1 | 2.00 | $5.9 \times 10^{-14}$ |
| 2 | 4.00 | $3.7 \times 10^{-14}$ |
| 3 | 4.50 | $4.0 \times 10^{-13}$ |
| 4 | 5.50 | $4.9 \times 10^{-12}$ |
| 5 | 6.50 | $2.5 \times 10^{-09}$ |

[1]20 percent by weight of a polyurethane/80% Cul composite and 80 percent by weight of a polymethylmethacrylate/19% carbon black composite.

Coating weights of polymer or polymers on the carrier core in excess of about 5 percent weight also enable, for example, insulative carrier properties with varying triboelectric values. For example, using a 30 micron porous strontium ferrite core, obtained from PowderTech Corporation, the triboelectric value of a carrier coated with various percentages of polymer comprised of a mixture of polyvinylidene fluoride and a carbon black doped polymethylmethacrylate are listed in Table 4 as a function of the total polymer coating weight (obtained from Examples 8 through 10 above). At polymer coating weights below about 4 percent by weight, the three carriers have the same triboelectric value. The carriers become triboelectrically differentiated at coating weights of 8 weight percent.

TABLE 4

Triboelectric values of coated carriers as a function of coating composition with increasing coating weight

| Coating Weight | 30:70[1] | 50:50[1] | 70:30[1] |
|---|---|---|---|
| Pass #1 2.0% | 29.2 | 29.1 | 31.4 |
| Pass #2 2.0% additional (4.0% total) | 25.5 | 26.7 | 28.1 |

TABLE 4-continued

Triboelectric values of coated carriers as a function of coating composition with increasing coating weight

| Coating Weight | 30:70[1] | 50:50[1] | 70:30[1] |
|---|---|---|---|
| Pass #3 2.0% additional (6.0% total) | not measured | not measured | not measured |
| Pass #4 2.0% additional (8.0% total) | 7.7 | 17.2 | 22.6 |

[1]ratio of polyvinylidene fluoride to carbon black doped polymethylmethacrylate.

EXAMPLE XI

Multiple Pass Resin Coating with Dissimilar Resins on Porous Strontium Ferrite Core Particles A strontium ferrite core obtainable from PowderTech with a nominal diameter of 75 microns and a BET surface area of 1,724 square centimeters per gram was substantially porous and structurally weak or friable by physical observation. The ferrite core is blended with a first resin, for example, a powdered thermoset, such as the commercially available thermoset polymer Envirocron from PPG Industries, at 4.5 weight percent, and melt flowed into the pores of the core and then crosslinked in a kiln at 400 degrees Fahrenheit, for 30 minutes. The conductivity of the resulting coated beads is expected to be about $10^{-14}$ mho per centimeter at 50 volts. The core particles prior to coating had a conductivity of $10^{-11}$ mho per centimeter. A second resin such as a carbon black doped polymethylmethacrylate with 19 percent carbon black and a nominal particle size of about 3 microns is blended with the aforementioned coated beads at a loading of 1.5 weight percent and melt fused at 400 degrees Fahrenheit in a kiln for 30 minutes. The resulting twice coated beads are expected to have a conductivity of about $10^{-8}$ mho per centimeter at 50 volts and a tribo of about 25 $\mu$C/gram with the procedure and reference toner described in the above Examples. The pores observed in the original uncoated strontium ferrite beads are apparently completely filled, or in the alternative, covered with one or both the coating polymer resins. The BET surface area of the twice coated material is dramatically reduced and these twice coated core particles are now mechanically robust.

Other modifications of the present invention may occur to one of ordinary skill in the art based upon a review of the present application and these modifications, including equivalents thereof, are intended to be included within the scope of the present invention.

What is claimed is:

1. A process comprising:

blending porous core particles with a first coating resin or resin mixture to produce a first blend;

heating the resulting first blend to produce first coated particles;

blending the resulting first coated particles with a second coating resin or resin mixture to form a second blend; and heating the second blend to afford second or twice coated particles, wherein the twice coated particles exhibit electrical conductivity values from about $10^{-6}$ to about $10^{-15}$ mho/cm at about 50 volts.

2. A process in accordance with claim 1, wherein said core particles are highly porous with a BET surface area of from about 0.01 to about 1.0 square meters per gram.

3. A process in accordance with claim 1, wherein said first coating resin is a cross-linkable thermoset resin selected from the group consisting of polyurethanes, polyesters, polyacrylics, phenolic resins, amino resins, epoxy resins, and mixtures thereof.

4. A process in accordance with claim 3, wherein the heating of the first blend is at or above the crosslinking temperature of said coating resin.

5. A process in accordance with claim 1, wherein said first coating resin is selected from the group consisting of non-crosslinked thermoplastics, crosslinked thermoplastics, thermoset plastics, and mixtures thereof.

6. A process in accordance with claim 1, wherein said core particles are selected from the group consisting of ferrites, magnetites, porous or sponge metallic cores, and mixtures thereof.

7. A process in accordance with claim 1, wherein said first coating resin fills the pores of said core particles at low loading weights of from about 0.5 to about 15 weight percent.

8. A process in accordance with claim 1, wherein the heating is accomplished at a temperature of from about 300 to about 500° F. in a rotatory kiln.

9. A process in accordance with claim 1, wherein the second coating resin is selected from the group consisting of polymers and mixtures thereof which impart triboelectric values of from about −60 $\mu$C/gram to about +60 $\mu$C/gram, and mechanical stability to the resulting coated particles.

10. A process in accordance with claim 1, wherein the core particles have a volume average diameter of from about 10 to about 150 microns.

11. A process in accordance with claim 1, wherein the core particles have a volume average diameter of from about 10 to about 60 microns.

12. A process in accordance with claim 1, wherein the total weight of the first and second coating polymers applied are in amounts of from about 1 to about 20 weight percent of the total weight of the uncoated core particles.

13. A process in accordance with claim 1 wherein the first coating resin or coating resin mixture and the second coating resin or coating resin mixture are sequentially and separately applied to the core particles from about 2 to about 10 times.

14. A process in accordance with claim 1 further comprising wherein the first coating resin contains a conductive compound selected from the group consisting of a pigment, a metal halide, metals, metal oxides, and mixtures thereof.

15. A process in accordance with claim 1, wherein the first and second coating resin or resin mixtures selected are of the same composition.

16. A process in accordance with claim 1, wherein the first and second polymer coating resin or resin mixtures selected are dissimilar.

17. A process for the preparation of resin coated carrier particles comprising:

a) dry blending core particles with a first coating resin or resin mixture to produce a first blend;

b) heating the resulting blend to produce first coated particles;

c) repeating steps a) and b) with the first coating resin or resin mixture and the intermediate resulting coated particles from 1 to about 20 times;

d) blending the coated particles of step c) with a second coating resin or resin mixture to form a second blend;

e) heating the second blend to produce second resin coated particles; and f) repeating steps d) and e) with the second coating resin or resin mixture and the intermediate resulting coated particles from 1 to about 20 times; wherein there results multiple resin coated core particles, wherein the multiple resin coated core particles exhibit electrical conductivity values from about $10^{-6}$ to about $10^{-15}$ mho/cm at about 50 volts.

18. A process in accordance with claim 17, wherein the first and second coating resin are triboelectically dissimilar.

19. A process in accordance with claim 17, wherein the total coating weight is from about 1 to about 30 weight percent based on the weight of the uncoated carrier core particles.

20. A process in accordance with claim 17, wherein the resulting coated carrier has a triboelectric charge of from about +60 $\mu$C/gram to about −60 $\mu$C/gram and a conductivity of from about $10^{-6}$ mho/cm to about $10^{-15}$ mho/cm at about 50 volts.

21. A process in accordance with claim 1, further comprising collecting, cooling, and sizing the resulting said first and second coated particles.

* * * * *